US009592887B2

(12) United States Patent
Frabetti

(10) Patent No.: US 9,592,887 B2
(45) Date of Patent: Mar. 14, 2017

(54) WATERCRAFT WITH TRANSLATIONALLY SHIFTING STERN PLATFORM

(71) Applicant: FERRETTI S.P.A., Cattolica (Rimini) (IT)

(72) Inventor: Andrea Frabetti, Zola Predosa (IT)

(73) Assignee: FERRETTI S.P.A, Cattolica (Rimini) (IT)

( * ) Notice: Subject to any disclaimer, the term of this patent is extended or adjusted under 35 U.S.C. 154(b) by 0 days.

(21) Appl. No.: 14/889,244

(22) PCT Filed: May 7, 2014

(86) PCT No.: PCT/IB2014/061269
§ 371 (c)(1),
(2) Date: Nov. 5, 2015

(87) PCT Pub. No.: WO2014/181269
PCT Pub. Date: Nov. 13, 2014

(65) Prior Publication Data

US 2016/0083050 A1 Mar. 24, 2016

(30) Foreign Application Priority Data

May 9, 2013 (IT) ..... MI2013A0748

(51) Int. Cl.
*B63B 23/32* (2006.01)
*B63B 27/14* (2006.01)
(Continued)

(52) U.S. Cl.
CPC ..... *B63B 27/143* (2013.01); *B63B 23/32* (2013.01); *B63B 2019/086* (2013.01); *B63B 2029/022* (2013.01)

(58) Field of Classification Search
CPC ..... B63B 35/40; B63B 25/006; B63B 19/08
See application file for complete search history.

(56) References Cited

U.S. PATENT DOCUMENTS 4,292,915 A * 10/1981 Nemec ..... B63B 25/006 114/260
4,319,540 A * 3/1982 Koskivirta ..... B63B 25/006 114/260

(Continued)

FOREIGN PATENT DOCUMENTS

| | | |
|---|---|---|
| DE | 20021841 U1 | 5/2002 |
| EP | 2145820 A1 | 1/2010 |
| FR | 2762577 A1 | 10/1998 |

OTHER PUBLICATIONS

International Search Report and Written Opinion mailed Jul. 29, 2014 for PCT/IB2014/061269 to Ferretti S.P.A. filed May 7, 2014.

*Primary Examiner* — Edwin Swinehart
(74) *Attorney, Agent, or Firm* — Vorys, Sater, Seymour and Pease LLP

(57) ABSTRACT

A watercraft includes a hull provided with a stern compartment inside the hull, the compartment being closed at least on the bottom by a movable portion of a stern platform arranged at one end of the compartment itself which opens up astern of the watercraft, wherein the movable portion can be lowered relative to the hull into the water where the watercraft is floating. The movable portion of the stern platform shifts with a translational motion along the hull without moving away therefrom.

16 Claims, 3 Drawing Sheets

(51) Int. Cl.
*B63B 29/02* (2006.01)
*B63B 19/08* (2006.01)

(56) References Cited

U.S. PATENT DOCUMENTS 4,738,642 A 4/1988 Koyama et al.
5,392,900 A * 2/1995 Sandwall ..... B63B 27/22
114/73
5,544,606 A 8/1996 Schmidt, Jr.
8,375,880 B1 2/2013 St. Clair, Jr. et al.

* cited by examiner

WATERCRAFT WITH TRANSLATIONALLY SHIFTING STERN PLATFORM

CROSS-REFERENCE TO RELATED APPLICATIONS

This is a §371 National Stage Application of International Application No. PCT/IB2014/061269 filed on May 7, 2014, claiming the priority of Italian Patent Application No. MI2013A000748 filed on May 9, 2013.

The purpose of the present invention is a watercraft according to the preamble of the main claim.

Watercrafts featuring a stern compartment used, for example, to contain a small boat or tender have long been known. Said compartment is usually closed by its own stern gate.

It is also known that in the stern portion many prestigious watercrafts feature a stern platform defined by a projecting plane suitable to act as a "bathing platform" for the watercraft passengers. However, the presence of this bathing platform hinders access to the stern compartment directly from the sea since, although allowing the presence thereof, it does not allow a floodable stern compartment to be implemented.

For this reason the implementation of said platforms in a movable manner is known, so that they can provide free access to said compartment from the sea.

Movable stern platforms are usually linked to the watercraft hull by means of articulated supports which, upon opening the stern compartment, lower the stern platform into the water and at the same time move it away from the hull.

The stern platform hence disappears in water at a distance from the hull which often prevents it from being reached by people embarked on the watercraft (for example to get on or off the tender when it is extracted or when it is introduced into the stern compartment). At any rate, said platform remains in such a position that the stern compartment cannot be flooded in order to ease the tender extraction therefrom or introduction thereinto.

In addition, said compartments feature the free or open end in any case distant from the surface on which the watercraft floats.

EP 2145820 describes a watercraft featuring a rear platform or stern platform movable relative to the hull, so that it can be plunged into the water. The platform comprises a treadable flat surface and, when plunged, acts as rest for swimmers or as housing for a small boat introduced into a stern compartment of the watercraft. However, the prior art document does not describe that said compartment is floodable and the movable platform is used to carry said watercraft to the sea. The prior art document hence does not even suggest that said compartment is floodable.

Also, when plunged into the water, the stern platform does not release an access to the compartment close to the water, so as to allow said compartment to be flooded.

U.S. Pat. No. 4,738,642 describes a water scooter which does not provide and cannot provide any floodable stern compartment for holding a small boat or tender. Accordingly, this prior art document cannot even suggest the implementation of a watercraft with floodable stern compartment suitable to hold a tender or the like.

DE 20021841 U1 relates to a watercraft provided with a stern with a transport device which can be plunged into the water in order to receive and carry an object from the water to the watercraft deck and the other way round. Telescopic elements allow said transport device to be moved.

This prior art document does not describe either a floodable stern compartment or an immersible stern platform. The stern platform of DE 20021841 is fixed, so that the prior art document cannot even suggest to the man skilled in the art that the stern compartment of the watercraft can be flooded.

An object of the present invention is to provide a watercraft having a floodable stern compartment which can be reached from the sea and which at the same time has the rear "bathing platform" defined by a movable stern platform which is always reachable, also when it is plunged.

In particular, an object of the invention is to provide a watercraft wherein the movable stern platform or rear bathing platform can be used by people aboard the watercraft for easily accessing the tender at the launching stage.

Another object is to provide a watercraft of the above kind wherein the stern platform can be moved reliably and safely relative to the hull.

These and other objects which will appear obvious to the man skilled in the art are achieved by a watercraft according to the attached claims.

For a better understanding of the present invention the following drawings are herewith enclosed, by way of example but not by way of limitation, wherein.

Figure 1:
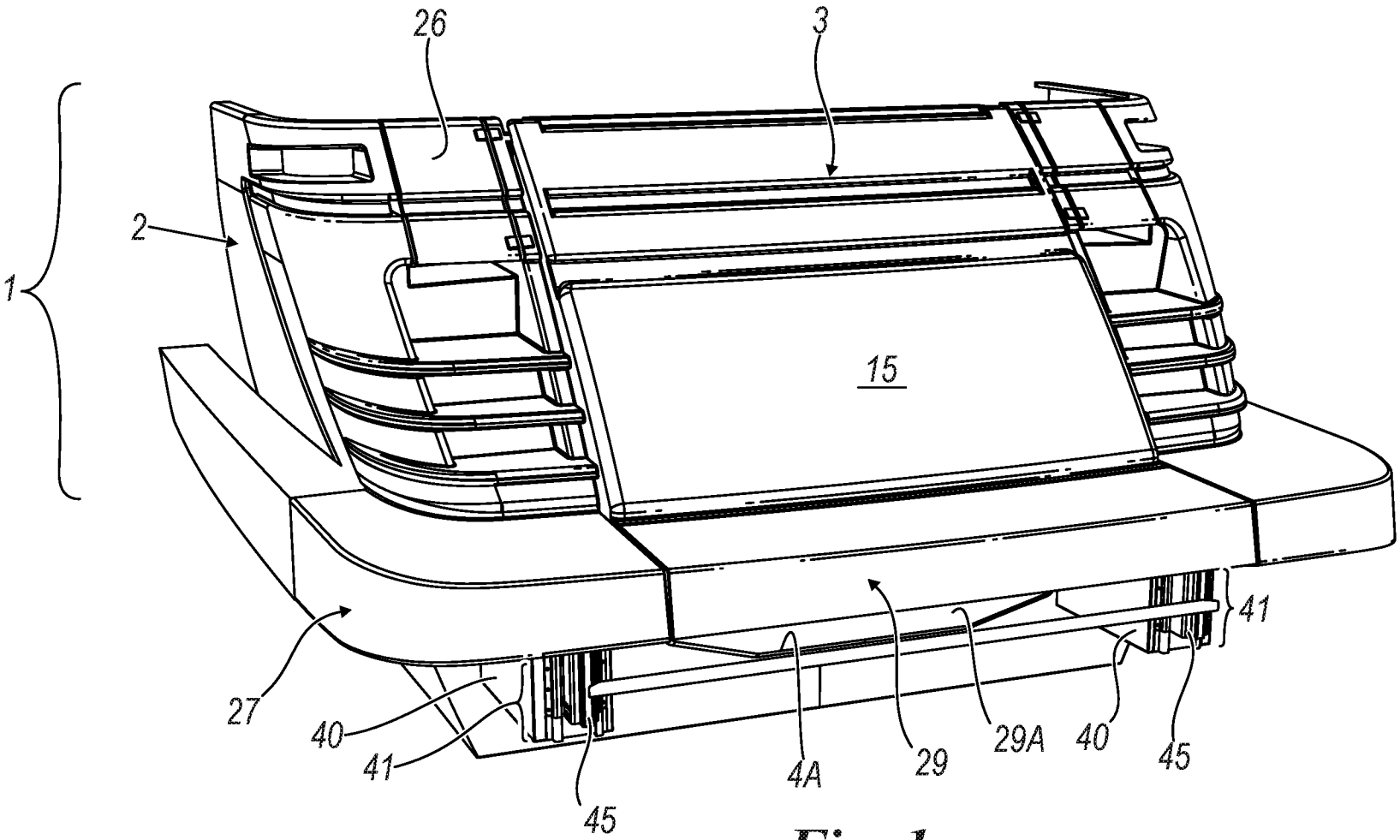
FIG. 1 shows the stern of a particular kind of watercraft achieved according to the invention, the stern compartment being closed.

With reference to the above-mentioned figures, a watercraft 1 is shown (partially and only in its stern portion) as comprising a hull 2 having a stern gate 3 suitable to reclose a stern compartment 4 suitable to contain a small watercraft such as a rubber dinghy or a tender (not shown). Said compartment 4 presents opposing side walls 6 to which hydraulic and/or pneumatic actuators 7, suitable to allow the gate 3 to be opened, are hinged. In particular, said actuators 7 are each associated to a wall 6 through a first end 8, their second end 9 being hinged to an inner wall 10 of the gate by means of eyelets 11 fastened to said wall.

The stern gate 3 comprises an outer wall 15 (generally made of fibreglass just like the hull portion), arranged at a distance from the wall 10 and connected therewith by means of side flanks 16 and 17 and a top and a bottom 20 and 21; said walls 10, 15, said side flanks 16 and 17 and said top and bottom 20 and 21 define a gate body 25. The actuators 7 are hinged in proximity of said flanks 16.

The outer wall 15 is suitable to be arranged on the same plane as a stern wall 26 of the watercraft 1 when the gate is reclosed.

A stern platform 27 projects from the bottom of the stern wall 26, suitable to define a rear side extension of the watercraft. Advantageously, a portion 29 of said stern platform, arranged in correspondence with the gate 3 or with the bottom end 4A of the compartment 4 which opens up astern of the watercraft (said end 4A being closed by a part 29A of portion 29), is advantageously movable so as to allow water to enter freely the stern compartment 4, which is thus floodable. This is meant to ease the launching of the tender stored in said compartment or else the retrieval of the tender therein.

More particularly, according to the invention, the portion 29 of the stern platform is movable along the hull, with a translational motion and parallel to itself, said portion 29 always remaining in proximity of the hull and in contact with its parts 40 along which the platform slides or shifts with a translational motion. This allows the platform portion 29 to be used as rest even when it is plunged (as a result of the opening of the compartment 4), for example in order to ease embarking or disembarking the tender at the launching or at the retrieval stage.

Indeed, even when it is completely opened and plunged into the water where the watercraft 1 is floating, the portion 29 certainly remains in proximity of the hull and on a plane parallel to the plane on which said portion lies when the compartment 4 is closed on the bottom (see FIGS. 1 and 2) in proximity of its end 4A. Said portion 29 can thus be easily reached by the remaining portion of the stern platform, integral with and fastened on the hull 2 (in FIG. 3 said portion is designated, by way of example, as 27A).

The portion 29 shifts with a translational motion along slides defined by the portions 40 mentioned above. Preferably a movable member 41, with which the platform portion 29 is functionally integral, is associated to said slides.

In an exemplary embodiment shown in the figures, said member 41 comprises telescopic elements 43, 44, 45, movable relative to one another and suitable to allow said portion 29 to shift without moving away from the hull 2 (as occurs in known solutions). More particularly, the element 43 is integral with the hull portion 40, the element 44 is movable relative to the element 43 and the element 45 (with which said portion 29 is integral) is movable relative to the element 44.

The motion of the individual elements can be attained through any one or more known actuators; for example, several pneumatic and/or hydraulic actuators can be provided, with which the elements 44 and 45 are integral, or else one or more electric motors can be provided, integral with the hull and suitable to move said elements and 45 by means of racks and rotating members. Said rotating members can be moved by mechanical transmission gears operated by the motor or motors mentioned above.

Of course, each member 41 can provide one or more movable elements such as the elements 44 and 45 mentioned above and said elements can be arranged in a continuous manner, in any position relative to each other and in any position relative to the element 43 fastened on the hull; this allows the platform portion 29 to be arranged in different positions relative to the hull 2, depending on the needs. For example, said portion 29 can be lowered relative to the hull even only to create a resting area plunged into the water, without opening completely the compartment 4 (which means without opening the gate 3) and allowing it to be flooded.

In addition, if two or more mutually movable elements of member 41 are provided, a stop is provided at the end of the element 43 integral with the hull and on any movable element functionally associated thereto, so as to stop the "extension" of member 41 at a maximum extent (without prejudice to the possibility to prolong said member 41 to any extent between the completely closed position (FIGS. 1 and 2) and the completely "extended" position (FIG. 3), as described above).

Figure 2:
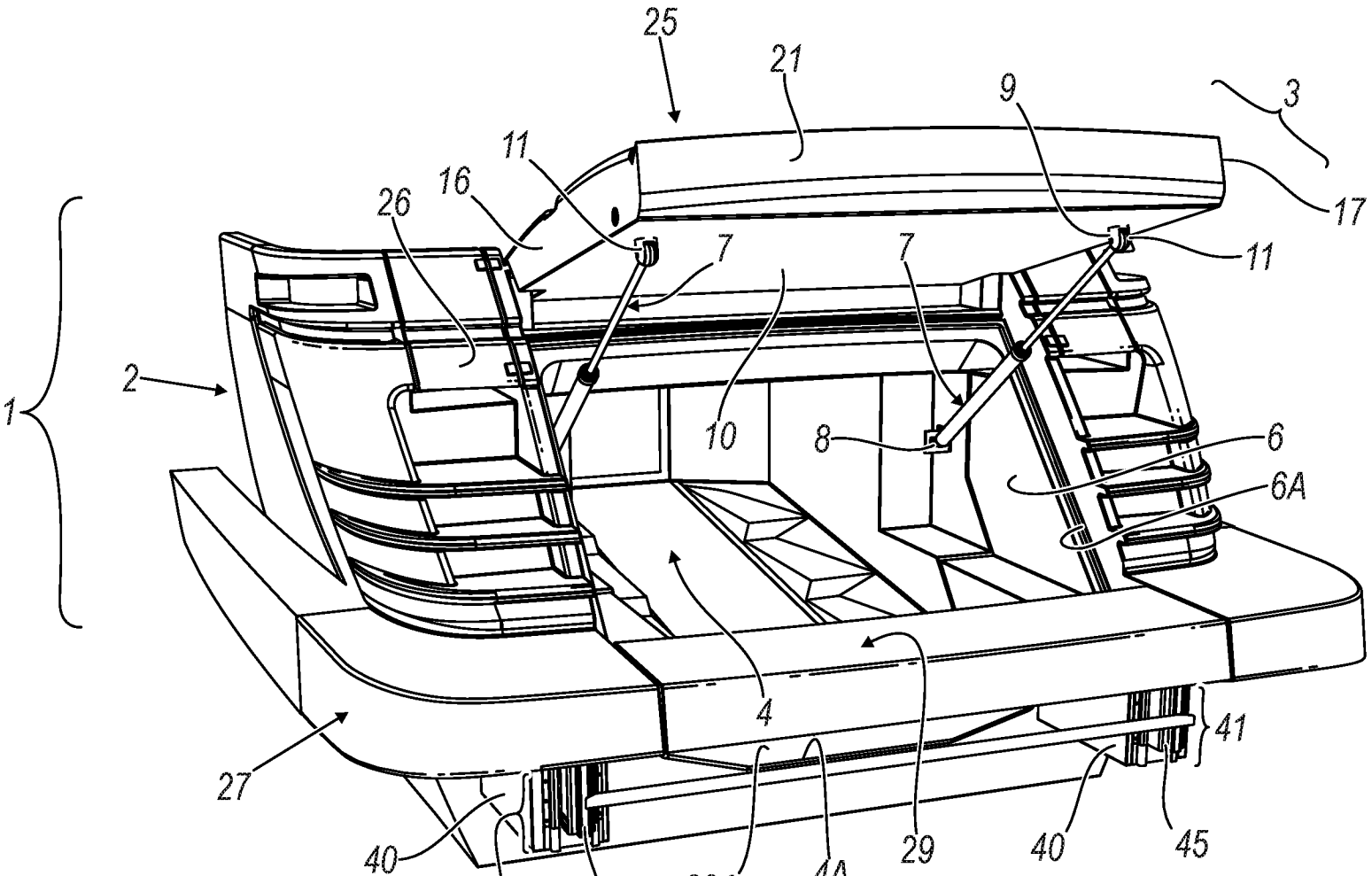
FIG. 2 shows the stern of the watercraft of FIG. 1, the stern gate being opened upwards.
Figure 3:
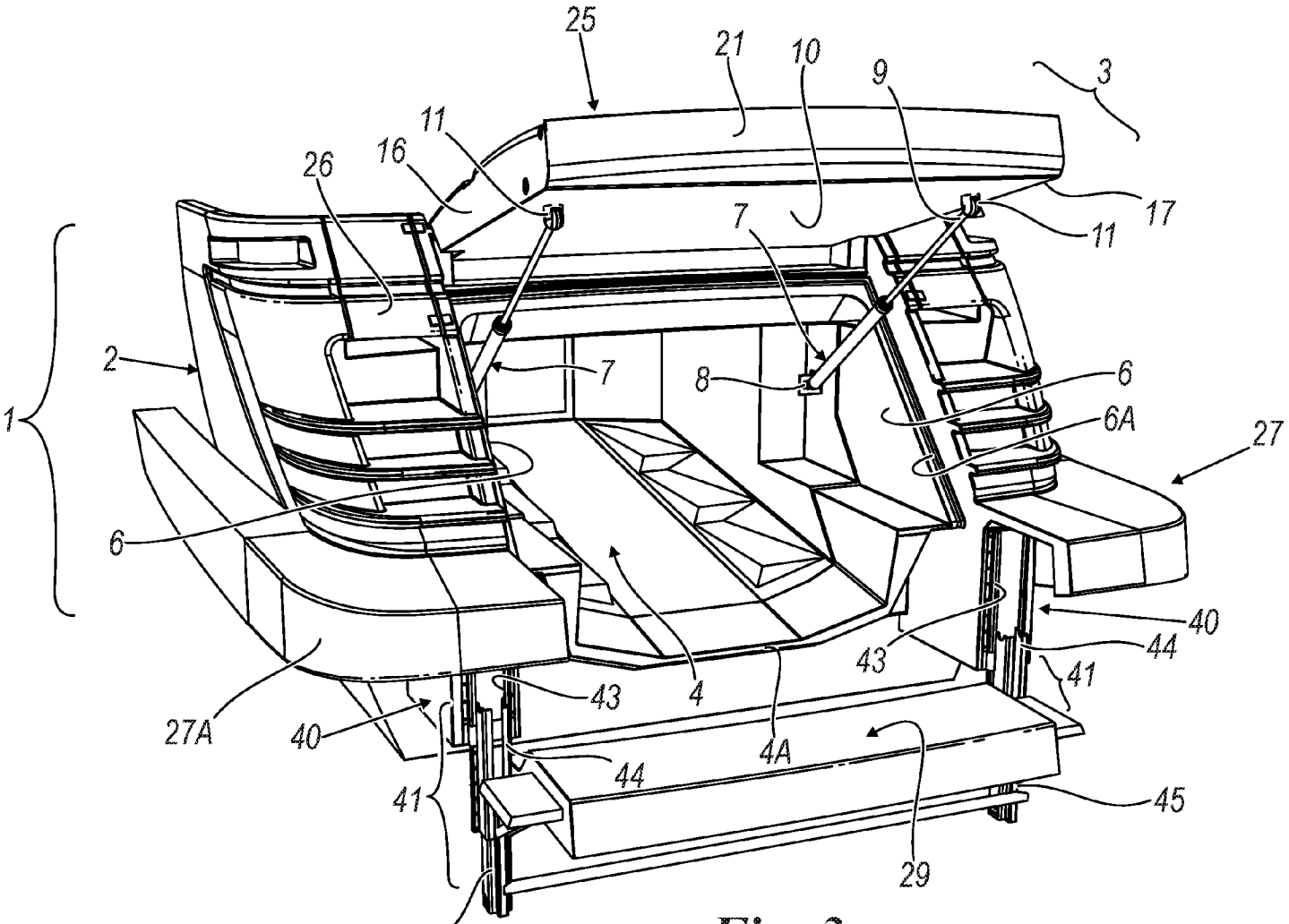
FIG. 3 shows the stern of the watercraft of FIG. 1, the stern platform being opened downwards, thus allowing the stern compartment, which is flooded, to be accessed from the sea.

Of course, in the present text the terms top, bottom are to be considered with reference to FIGS. 1-3, namely with reference to the watercraft hull. The terms "right, left" are to be considered with reference to FIGS. 1-3.

As a result of the invention, with a movement of the platform portion 29 a rapid flooding of the compartment 4 can be obtained and a tender can be extracted therefrom or introduced thereinto directly from the water, bottom end 4A of said compartment being at least close to the surface of the latter. This favours the handling operations of said tender, also because people operating thereonto can lean on the platform portion 29 plunged into the water; this occurs in full safety, since said platform portion remains adjacent to the hull and no gap forms between them, such that people might fall pushed by the water or having slipped on the platform.

Several embodiments of the invention have been described and quoted. However, further embodiments are possible in the light of the above description and are to be considered as falling within the scope of the following claims. By way of example, the compartment 4 might be reclosed only on the bottom by the (movable) portion 29 and might not feature the gate 3 (but rather be opened in correspondence with the position of the gate shown in the figures). This solution can, for example, be used in smaller-sized, less prestigious watercrafts than those having also a gate such as the one designated as 3 in the figures attached to the present description.

The invention claimed is:

1. A watercraft comprising:

a hull for locating on water, the hull having a stern provided with a stern compartment inside said hull, said stern compartment being closed at least at its bottom end by a movable portion of a stern platform, said compartment opening astern of the watercraft, wherein said movable portion of the stern platform is movable from a first upper position when the compartment is closed at its bottom to a second lower position whereby the movable stern platform can be lowered relative to the hull into the water, wherein the stern platform projects generally horizontally from the bottom of the stern to provide a generally horizontal upper planar surface, an actuator for moving the movable portion of the stern platform from the first position to the second position, the actuator selected from the group consisting of an electric motor-driven actuator, a hydraulic actuator, and a pneumatic actuator, said actuator associated to the hull, wherein said bottom end of the stern compartment is arranged for being at least in proximity of the water, said movable portion of the stern platform being able to shift from the first position into the water at the second position with a translational motion parallel to a portion of the hull along the portion of the hull, but remaining in proximity of the hull and maintaining the upper planar surface of the moveable portion of the stern platform on a plane parallel to the plane on which the upper planar surface of said movable portion of the stern platform lies when the compartment is closed at its bottom, said stern compartment being flooded as a result of said motion of the stern platform, wherein said actuator is associated to the hull portion along which the movable portion of the stern platform shifts, wherein said actuator is of a telescopic kind and comprises a plurality of elements movable relative to one another, one of said elements supporting the movable portion of the stern platform, wherein a first element of said plurality of elements is integral with the portion along which the movable portion of the stern platform shifts, a second element movable relative to said first element being provided, wherein the portion of the hull along which the moveable portion of the stern platform shifts with the translational motion comprises parallel slides in contact with the moveable portion of the stern platform, wherein the slides and plurality of elements movable relative to one another are lower than the generally horizontal upper planar surface of the movable portion of the stern platform in the first upper position, wherein the telescopic element supporting the movable portion of the stern platform extends downwardly relative to the first telescopic element, when the movable portion of the stern platform is in the second lower position.

2. A watercraft according to claim 1, wherein each slide the stern platform further comprising stationary portions, the stationary portions flank the moveable portion in the first position, wherein the slides are under respective said stationary portions of stern platform, wherein in the first position the moveable portion of the stern platform is generally horizontally aligned with the slides and projects rearward relative to the slides and moveable elements.

3. A watercraft according to claim 1, wherein each slide has a respective said actuator of telescopic kind comprising a respective said plurality of elements movable relative to one another, wherein a cross-piece below the moveable portion of the stern platform extends from each of the one of said elements of each plurality supporting the movable portion of the stern platform.

4. A watercraft according to claim 1, wherein the movable portion of the stern platform is adapted to take on a plurality of positions between the first position wherein it is close to the end of the compartment opening up astern of the watercraft and the second position wherein said portion is farther from said end in said positions the movable portion of the stern platform remaining in proximity of the hull without any gap between said portion and the hull.

5. A watercraft according to claim 1, wherein a gate to close the stern compartment is provided above the movable portion of the stern platform and is movable relative thereto.

6. The watercraft according to claim 1, wherein the actuator is the hydraulic actuator.

7. A watercraft for operating on the water, the device comprising:

a hull having a stern compartment located inside the hull;

a movable platform configured to open or close a lower portion of the compartment, the movable platform being configured to be lowered into the water relative to the hull to a lower position to open the lower portion of the compartment and later raised out of the water to an upper position to close the lower portion of the compartment; and an actuator device configured to raise and lower the moveable platform with a translational motion, the actuator device being configured to translate the movable platform in close proximity to and along the hull without a gap between the movable platform and the hull during any lowering or raising operation of the movable platform, wherein the actuator is associated to the hull portion along which the movable portion of the stern platform shifts, wherein the actuator is of a telescopic kind and comprise a plurality of elements movable relative to one another, one of said elements supporting the movable portion of the stern platform, wherein a first element of said plurality of elements is integral with the portion along which the movable portion of the stern platform shifts, a second element movable relative to said first element being provided, wherein the portion of the hull along which the moveable portion of the stern platform shifts with the translational motion comprises parallel slides in contact with the moveable portion of the stern platform, wherein the plurality of elements movable relative to one another are lower than the generally horizontal upper planar surface of the movable portion of the stern platform in the upper position, wherein the telescopic element supporting the movable portion of the stern platform extends downwardly relative to the first telescopic element, when the movable portion of the stern platform is in the lower position.

8. The watercraft according to claim 7, further comprises a movable stern port configured to open an upper portion of the compartment.

9. The watercraft according to claim 8, wherein the movable stern port cooperates with the movable platform to close the compartment.

10. The watercraft according to claim 8, wherein a bottom of a port body of the movable stern port cooperates with a top of the movable platform to close the compartment.

11. The watercraft according to claim 7, wherein the hull and compartment together are configured so that the compartment is at least partially flood when the movable platform is lowered into the water to some extent.

12. The watercraft according to claim 7, further comprising stationary portions, the stationary portions flank the moveable portion in the upper position, wherein the slides are under respective said stationary portions of stern platform, wherein in the upper position the moveable portion of the stern platform is generally horizontally aligned with the slides and projects rearward relative to the slides and moveable elements.

13. The watercraft according to claim 7, wherein the movable platform projects from a bottom portion of a stern wall of the hull to define a rear side extension of the watercraft.

14. The watercraft according to claim 7, wherein the actuator device is a hydraulic actuator.

15. A watercraft according to claim 7, wherein each slide has a respective said actuator of telescopic kind comprising a respective said plurality of elements movable relative to one another, wherein a cross-piece below the moveable portion of the stern platform extends from each of the one of said elements of each plurality supporting the moveable portion of the stern platform.

16. A watercraft according to claim 7, wherein the movable portion of the stern platform is adapted to take on a plurality of positions between a first position wherein it is close to the end of the compartment opening up astern of the watercraft and a second position wherein said portion is farther from said end in said positions the movable portion of the stern platform remaining in proximity of the hull without any gap between said portion and the hull.

* * * * *